US008756820B2

(12) United States Patent
Bartolini

(10) Patent No.: US 8,756,820 B2
(45) Date of Patent: Jun. 24, 2014

(54) GARMENT MEASURER

(75) Inventor: Luigi Bartolini, Poppi (IT)

(73) Assignee: Sartorie Associate S.R.L., Poppi (AR) (IT)

( * ) Notice: Subject to any disclaimer, the term of this patent is extended or adjusted under 35 U.S.C. 154(b) by 326 days.

(21) Appl. No.: 13/262,641

(22) PCT Filed: Apr. 16, 2009

(86) PCT No.: PCT/IT2009/000172

§ 371 (c)(1),
(2), (4) Date: Oct. 3, 2011

(87) PCT Pub. No.: WO2010/119463

PCT Pub. Date: Oct. 21, 2010

(65) Prior Publication Data

US 2012/0023764 A1 Feb. 2, 2012

(51) Int. Cl.
*A41H 1/04* (2006.01)

(52) U.S. Cl.
USPC ..... 33/8

(58) Field of Classification Search
USPC ..... 33/2 A, 2 H, 2 R, 7, 8, 9 A, 9 R, 10, 11, 33/16, 512, 515, 759, 770; 248/124.1, 248/124.2, 125.1, 309.4, 523, 537, 539, 248/542, 543
See application file for complete search history.

(56) References Cited

U.S. PATENT DOCUMENTS

| | | | | | |
|---|---|---|---|---|---|
| 177,702 | A | * | 5/1876 | Ender | 33/8 |
| 1,168,431 | A | * | 1/1916 | Schuman | 33/7 |
| 2,196,145 | A | * | 4/1940 | Stanziale | 33/10 |
| 2,246,744 | A | | 6/1941 | Manus | |
| 2,645,015 | A | | 7/1953 | Zielaskowski | |
| 2,763,062 | A | * | 9/1956 | Valentine | 33/9 A |
| 2,795,852 | A | * | 6/1957 | Ermilio | 33/8 |
| 2,818,648 | A | * | 1/1958 | Jochheim | 33/8 |
| 3,031,215 | A | * | 4/1962 | Vance | 403/59 |
| 3,418,717 | A | * | 12/1968 | Gloninger et al. | 33/8 |
| 3,439,424 | A | * | 4/1969 | Belmont, Sr. et al. | 33/8 |
| 5,094,418 | A | * | 3/1992 | McBarnes et al. | 248/286.1 |
| 6,754,974 | B2 | * | 6/2004 | Bassolino et al. | 33/759 |
| 2004/0107593 | A1 | | 6/2004 | Rego | |

FOREIGN PATENT DOCUMENTS

| | | | | | |
|---|---|---|---|---|---|
| FR | 1404501 | | | 7/1965 | |
| GB | 10201 | | | 5/1916 | |
| JP | 08243089 | A | * | 9/1996 | A61B 5/107 |

* cited by examiner

*Primary Examiner* — R. A. Smith
(74) *Attorney, Agent, or Firm* — Themis Law

(57) ABSTRACT

A device for reading measures of a body for making clothing in general includes an arm; measuring elements configured to take measurements of the clothing, wherein the arm is telescopic in such a way to result selectively extendable or retractable; and a system to fix the arm at a chosen length in a way to allow making, in correspondence of the chosen length, through the measuring elements, a reading of at least a measure of the body.

13 Claims, 11 Drawing Sheets

GARMENT MEASURER

TECHNICAL FIELD

The present invention refers to the technical field of tailoring. In particular it refers to a device for the acquisition of measures for the realization or adjustment of clothing in general.

BACKGROUND ART

It is known how, after a piece of clothing is bought, the help is often required of a tailor or an operator to realize adjustments and adaptations of the same with respect to the body of the buyer. For example it is frequent and common to purchase garments in clothing shops. In such cases the client can anyway ask to have adjusted some measures of the acquired garment in order to adapt it to his own body. For example it could be asked to tighten the shoulders of a jacket, or the waist of a shirt. These are some of the examples of changes that can be asked to the shopkeeper.

Moreover, it is very frequent also the case where people are absolutely out of the ordinary standard measures of industrial type clothing. In such a case, it is necessary to buy custom-made clothing which, even if sometimes of a higher cost respect to the common industrially made cloths, offer substantial comfort when worn. Moreover, adapting perfectly to the specific measures of the person, guarantees a precious aesthetic result. Such need is required also in the realization of specific sport clothing. This is for example the case of diving suits which are always more frequently custom made.

In such situations, especially in the case of custom-made clothing, it is necessary that an operator with experience, or rather a tailor, takes all the necessary measures of the person in order to be able to make the garment. It is thus a common procedure to take directly on the body of the person the measures as for example the crotch of the trousers, the circumference of the waist and of the trunk, the height of the shoulders and other specific measures of interest. All these measures allow then the tailor to make trousers, jackets and garments in general with specific wearability for the person who will wear them. Also in the case of a simple adjustment of the purchased garment it is necessary that the tailor takes such measures on the person.

In both of the above mentioned cases it is thus clear how the operation of measuring is fundamental and how the final success of the garment depends on it. Any wrong measurements can cause a final wrong realization and consequently unnecessary costs for the purchaser, other than his dissatisfaction. Moreover, in the case of custom-made garments, it is necessary to take at least some fundamental measures of the body of the person, or it will possible to fail producing a garment of proper size.

It is thus clear how such operation, if made by inexperienced or careless operators, can cause economic damages to the purchaser of the garment who will have a custom-made garment different from his size, or even not made within the pre-established time limits because of some missing measures.

Nowadays, not all the shopping centers have specialized personnel and this would cause measuring results that are completely wrong. For example the manual operation for measuring the waist is commonly made by positioning the measuring tape around the waist of the person and reading the corresponding measure. However, in the case for example of large size persons, the operation is not easy and often the operator cannot surround with the measuring tape the body of the person in a precise way, especially if the operator is small-bodied. It is then frequent that the measuring tape does not perfectly surround the waist of the client but ends up being raised or dropped from it, maybe because it is not sufficiently tight. If the operator does not have much experience it is then frequent the case where the measure is not correct, causing an inaccurate final result and clothing that have measures that are not very precise.

Moreover, also in the case of experienced operators, nowadays such operation requires some time in order to be made precisely. This implies a sacrifice to the client that has to pose for a long time in order to allow completing the measurements.

At last, the measurement of the inner part of the leg, for example for the realization or adjustment of trousers, can create discomfort to both the operator and the client.

In order to resolve the above described drawbacks, different solutions have been proposed. For example, U.S. Pat. No. 2,052,099 in the name of W. Litton, of which are available only the drawings, clearly represents an old device that allows taking different measurements directly on the person in order to realize a clothing. The proposed solution comprises a bar 3 projecting a graduated scale and supported by a supporting base 1. Different measuring arms (7, 8, 9) are assembled in a sliding manner on the bar thanks to the help of couplings 4. In such manner, by making the arms sliding along the bar until the desired height is reached, the relative height can be read and found. In addition, a measurement strip 22 can be assembled on one of such sleeves in such a way to bring it to the desired height and read the circumference measure.

However such device is very complex and has a bulky structure with a height that equals to at least a man of an average height. This makes it non transportable and thus not very easy to handle. This means that, in case of home works, the user will be forced to not use it. Moreover the device is perfectly suited for highly specialized persons and its structural complexity is such to make the operation even more complex than a normal measurement made manually, as in the tradition. Given its dimension and its structural complications, it can just be targeted for a specialized group of people and not to a large distribution where dealers are also found of industrially made clothing.

Moreover such structural complexity makes the same extremely expensive. It is thus clear how such technical solution does not simplify the work but, in the contrary, makes it more complex requiring therefore a high competence for the use of the same.

Other patents, as for example U.S. Pat. No. 3,753,293 in the name of Branda et Al., describe extremely complex and bulky devices where the extraction/retraction mechanism and raising/lowering movement allow activation of the measurement systems. However such devices imply the use of electronic and mechanical parts that are complex and expensive. They are also very difficult to use, hardly transportable and do not allow fast measurements. Moreover they require a continuous maintenance of the mechanical parts that is extremely demanding.

DISCLOSURE OF THE INVENTION

It is therefore the aim of the present invention to provide a device for the measurement of a body in order to make clothing that resolves the above inconvenient.

In particular it is the aim of the present invention to give a device that allows to take the measures for making a clothing that is easy to use, allowing an operator this way to take in a fast and precise manner all the required measurements.

It is also the aim of the present invention to give a device that allows to take with accuracy the relative measurements for the realization of a clothing even by persons with not much experience in the field.

It is also the aim of the present invention to give a device that is easily transportable and at the same time constructively simple, reducing in this way considerably both the productive and maintaining costs of the same.

These and other aims are thus reached with the present device for the reading of measures on a body of a person for making cloths in general comprising an arm (2) and means (11, 13, 15, 18) to take measurements of the clothing.

In particular, the prefixed aims are obtained through the realization of a telescopic arm 2, or rather in a way to result selectively expandable or retractable in order to take a measurement on the body.

It is clear how such solution, compared to the prior art, allows a noteworthy encumbrance saving. Indeed the known devices have always at least a fixed arm of a predetermined height and are provided with means sliding on them to take the measures. Such solution implies a notable encumbrance in height, making the device non transportable and often structurally complex. According to such solution, on the other hand, the arm can lengthen and get retracted into therefore a chosen length to allow reading a measurement. In such way it results to be not very cumbersome when put back into the closing position at the end of the measurement and thus also easily transportable.

In order to take the measurement through the mentioned means (11, 13, 15, 18) it is necessary to block the arm into the chosen position. For such aim the arm comprises fixing means (6) to fix it at a chosen extraction length in such a way to allow, in correspondence of such length, a reading of the measurement of the body.

It is clear how such solution is easy to use even for non expert people. By simply fixing the desired position, it is possible to read easily at least a corresponding measure of the body, avoiding mistakes, for example caused by a lack of experience of the operator.

Advantageously, the arm (2) comprises a portion with a fixed base (4) and at least an upper portion (5) selectively extractable or retractable from/into the inside of said fixed portion.

According then to a possible solution of the invention that is constructively simple, the arm comprises a sole upper portion (5) selectively extractable or retractable from the portion with fixed base (4).

Both in the case of a constructive solution comprising different upper portions (5) and in the case of a sole upper portion (5), the portion with fixed base (4) comprises always a supporting base (3) in such a way that the arm (2) can, altogether, be placed on the ground in such a way to be emerging upward.

Such a solution is important because it gives a noteworthy efficiency to the present invention, which can this way be placed on the ground close to the body and allow to the operator to comfortably take all the required measurements by simply lengthening or shortening the arm and fixing it then at the required position.

For such aim, thus, the mentioned means (11, 13, 15, 18) to take the measures of the garment comprise at least a supporting element (15) comprising at least a device (13, 14, 18, 19) that allows reading at least a length and/or a width of the body.

In particular the supporting element (15) is placed in correspondence or closed to the upper end of the upper portion (5).

In such a manner the extraction and the retraction of the arm places the supporting element at the desired height and, at the same time, the operator can take the measures of the body by using such devices (13, 18, 19).

In greater detail, a possible constructive solution can comprise a sole supporting element 15 placed in correspondence of the portion 5 placed above. In particular, then, in the case of the solution with a sole portion 5, it is clear that the supporting element is placed at the top of such portion.

In particular, the above mentioned devices (13, 14, 18, 19) comprise at least a reference lever (13) or a bracket suitable to indicate the reaching of the chosen measuring point of the length of the cloth in correspondence of the lengthening or of the retracting of the arm.

Between the different chosen solutions, the reference lever can be, for example, integrated into the supporting element (15).

It is thus clear how such solution with the use of the bracket (13), other than having the advantage of a simple and fast measurement, resolves the problem of an embarrassing measurement for the client and the operator in the case where the crotch is measured.

Alternatively, the head can comprise a hook (14) to receive the reference lever.

According to such last solution, the hook (14) can then be of magnetic type while the lever (13) of metallic type in such a way to remain into the position on the hook.

In such case, thus, there is the advantage of a device that is less cumbersome and constructively simple. Indeed, instead of realizing a head that had integrated therewith a lever 13 projecting outward, a fast unhooking element is provided. When the lever is removed from the head after use it can be placed apart, reducing even more the encumbrances and making the transportation of the same easier.

According then to the above mentioned solutions, where the supporting element is placed on top of the portion 5 and comprises in an integrated or detached manner the bracket 13, there is also comprised a graduated scale (11) placed along said portion (5) and made in such a way to indicate the reached length in correspondence of the extraction or retraction of the upper portion (5) with respect to the fixed base portion (4).

The graduated scale works thus in combination with the reference bar 13 in a way to indicate the length measure of the body.

In particular the bar indicates the length where the extraction of the arm 2 must be stopped while the graduated scale indicates such length.

A particularly advantageous solution comprises the graduated scale (11) engraved directly on the upper portion (5).

In such case then, further to the extraction or refraction of the portion 5 until when the reference bar indicates the desired point on the body, it will be possible to read the length measure directly on the graduated scale 11, taking as reference for example the upper edge of the fixed portion 4 within which the movable portion 5 enters.

Moreover it is also possible to integrate a digital display in correspondence of the supporting element 15, which visualizes directly the measurement, avoiding this way to the user to bend down in order to check the graduated bar 11. The display is thus connected to some common means for electric reading, which visibly show on the reader the extracted measure of the telescopic arm and thus the measure of the height.

Advantageously the supporting element (15) comprises also a site (17) suitable to comprise a measuring tape (18) configured to allow taking a measure of a circumference in correspondence of the chosen length of the arm.

In such manner, when the desired height is reached, it is possible to take other than a length measurement also a measurement of the width or circumference of the body. Advantageously the site 17 for the measuring tape can be placed at a height corresponding to 6.5 centimeters from the bracket 13 when placed on the supporting element 15. In such manner, during the specific measurement of the crotch of a pair of trousers, it is automatically obtained also the pelvis measurement independently from whom takes these measures, even if the person has no experience.

Alternatively, equivalent solutions that comprise the sole site (17) for the reading of the circumference can be realized.

Advantageously the site is closed at the top by an upper lid (16) in such a way to bind the measuring tape within the site.

Advantageously, the means (6) to fix the arm at the chosen length comprise a knob (7) and a carved spacer (8) and are configured with such a diameter to surround the upper portion (5).

Moreover the knob is made to get screwed at the upper end of the fixed portion (4) in such a way to close the spacer around the upper portion, fixing it into position or to get unscrewed to allow the spacer to release the upper portion.

This mechanism, particularly simple constructively, allows to fix into the position the eventual movable portion/s 5 respect to the fixed one 4.

BRIEF DESCRIPTION OF THE DRAWINGS

Further features and advantages according to the present invention will be clearer with the following description of one of its embodiments, made to illustrate but not limit, with reference to the annexed drawings, in which.

FIGS. from 9 to 11 show realization steps of a pair of trousers, according to the use of the present invention.

DESCRIPTION OF A PREFERRED EMBODIMENT

Figure 1:
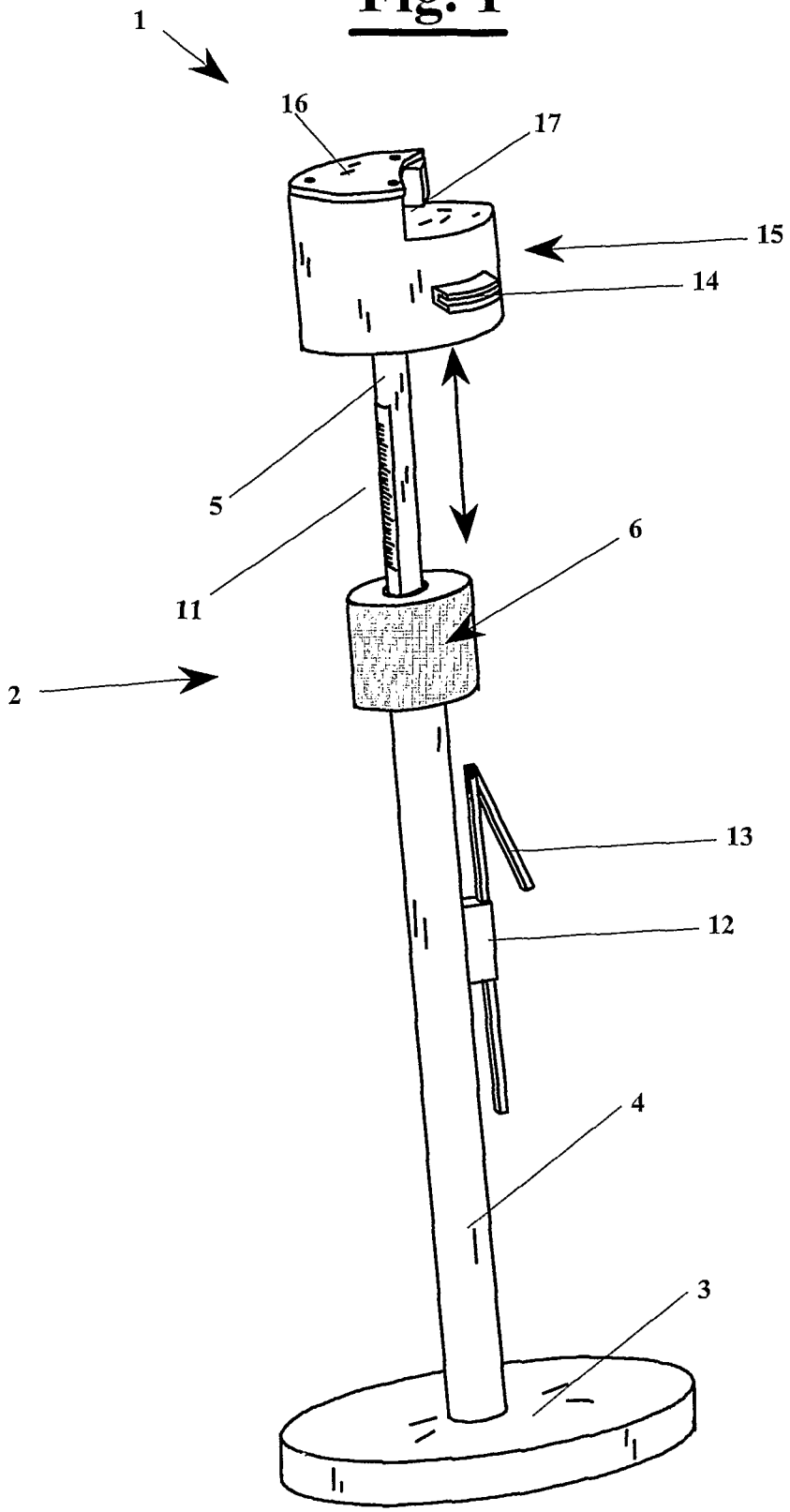
FIG. 1 represents an overall view of the present device according to the invention.

FIG. 1 shows, according to the invention, an overall view of the device for taking the measures on a body in general, particularly the body of a person, for making clothing. In its most essential aspects, the invention comprises an arm or bar 2 and means (11, 13, 15, 18) to allow to a user to take the measures that are specified further on in more detail.

The arm 2 is sustained through a supporting base 3 in such a way to be placed on the ground and emerge upwards.

Still as described in FIG. 1, the arm 2 is of telescopic type, or rather comprises some singular portions (indicated in the figure with the number 4 and 5) configured one inside the other in such a way to result selectively extractable and retractable. In such manner the arm results to be selectively stretchable and retractable and, according to such solution, the encumbrances in the retracted position are reduced as much as possible.

Still as described in FIG. 1, the fixed base portion 4 comprising the above mentioned supporting base 3 is configured to receive at least an upper portion 5 sliding in its inside. For such aim, the portion 4 is obviously hollowed, in such a way to be able to assemble in a sliding manner in its inside the different upper portions (for such aim look also at the details of FIGS. 2 and 3). In particular FIG. 1 shows the preferred solution of the invention constituted by a sole portion 5 sliding within said base 4.

Still with reference to FIG. 1, a blocking element 6 that can be selectively screwed and unscrewed (look at FIG. 1 and FIG. 2), is fixed in correspondence of the upper free end of the portion 4 by means of a common thread 9. By screwing the element 6 it is possible to fix into the position the portion 5 in correspondence to the chosen position. In the same manner, by unscrewing the blocking element, it is possible to make the portion 5 sliding with respect to the fixed portion 4, be able this way to lift it or re-enter it from and into the mentioned portion 4 exactly as indicated by the double arrow of FIG. 1.

Figure 2:
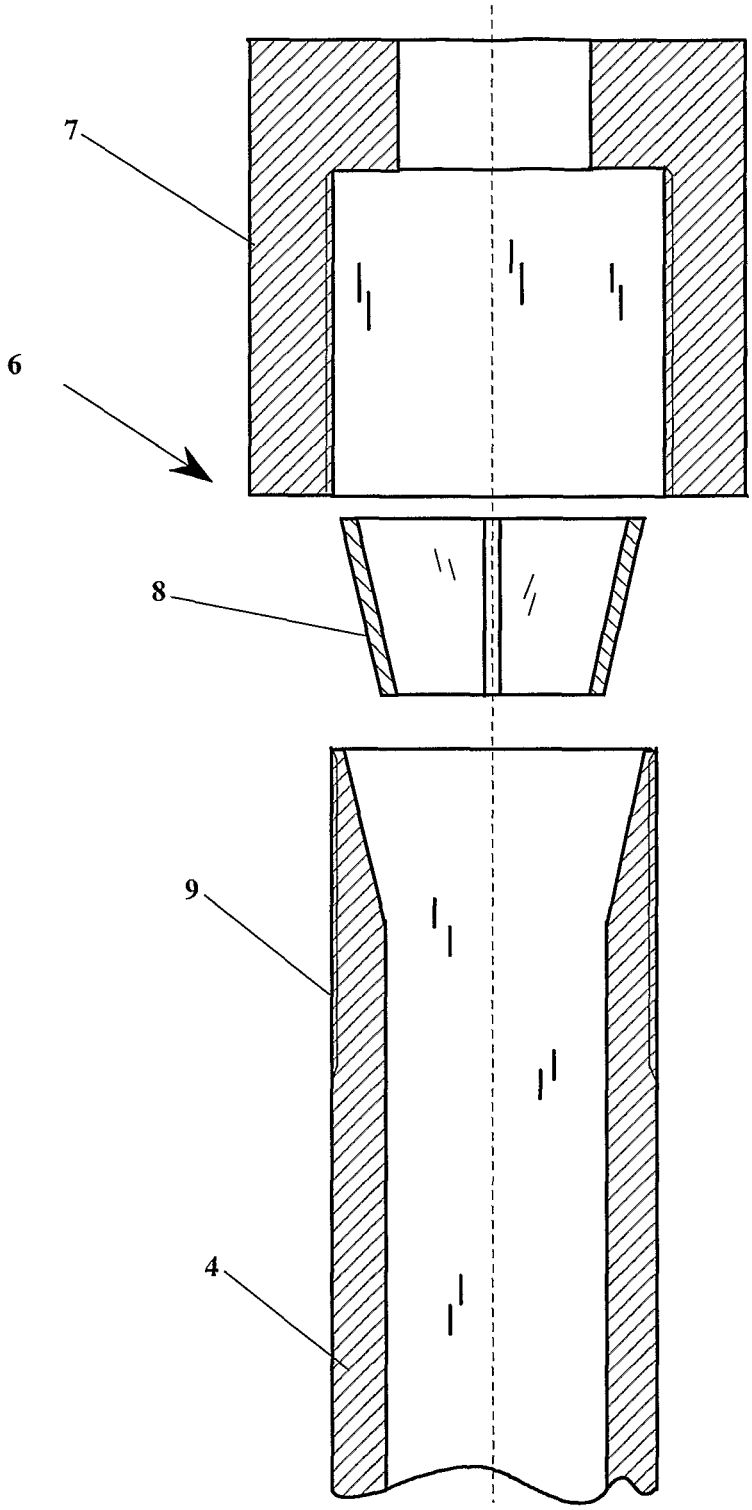
FIG. 2 represents a section that shows the coupling of the knob 7 with the carved spacer 8 and the fixed base portion 4.
Figure 3:
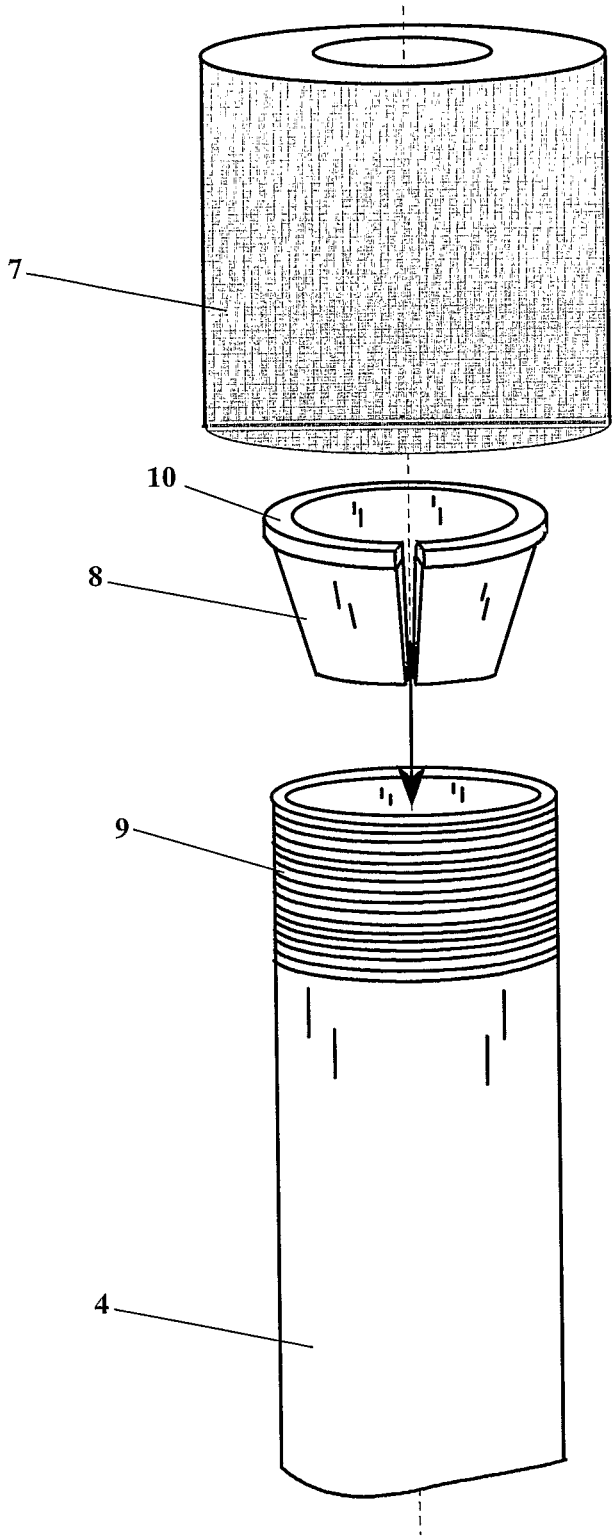
FIG. 3 shows, for clarity, a view of the coupling shown in FIG. 2.
Figure 4:
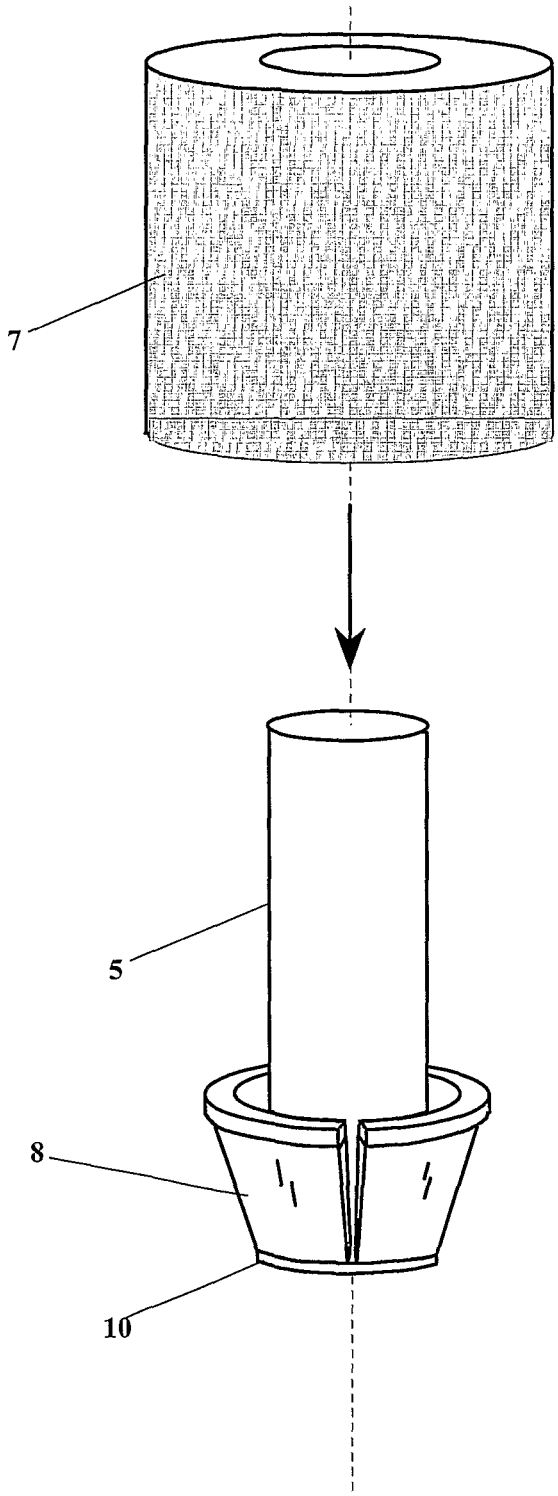
FIG. 4 represents the insertion of the knob 7 on top of the upper portion 5 of the arm 2.

As better described in the constructive detail of FIGS. 2 and 3, the fixed portion 4 comprises the thread 9 in correspondence of its upper end in a way to be able to couple the blocking element 6 to it. The blocking element comprises in combination a knob or metal ring 7 and a hollow spacer 8 having an upper annular wall 10 in such a way to lean around the circular perimeter of the portion 4 without falling into it. In order to make it clear, FIG. 4 indicates the coupling between the spacer and the upper portion 5 destined to enter in the site of the base portion 4. The knob and the spacer have thus a passing coaxial hole to allow the passage of the portion 5 which results sliding with respect to the fixed portion as described in FIG. 1.

In such manner, when used, by screwing the metal ring there is created a fixing action on the spacer that surrounds the portion 5. Such action determinates the closing of the thread of the spacer on the portion 5 realizing a grip and thus a blocking bind of the portion 5 respect to the portion 4. The opposite operation, or rather by the unscrewing of the knob 7, implies a release of the spacer and this the possibility of the portion 5 to slide respect to the portion 4.

Figure 5:
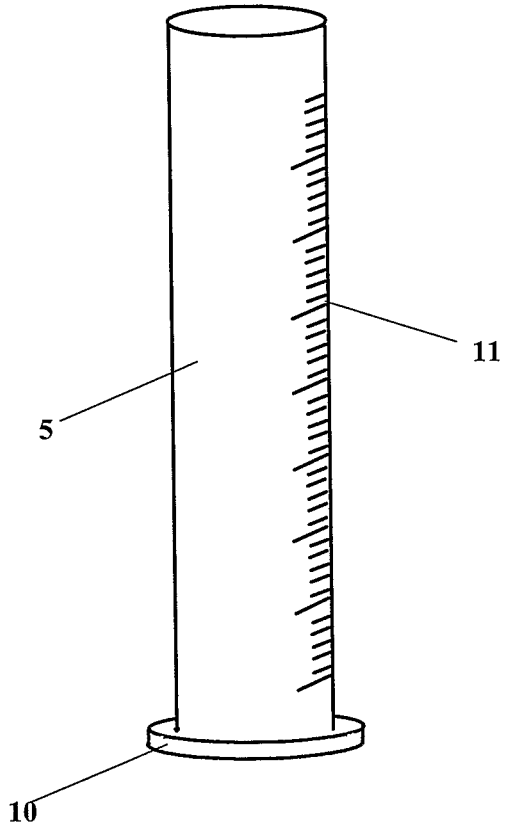
FIG. 5 shows a view in detail of an upper portion 5 on graduated scale of measurement for the length.

As shown in FIG. 5, the preferred embodiment of the invention comprises also a graduated scale 11 for length measurement directly obtained on the upper portion 5. Its functionality will be better explained later on.

Turning back to FIG. 1, the upper end or the top of the portion 5 assembles a supporting element 15 for at least a device (13, 18) that allows the reading of the measures of the body, in particular the reading of a length and/or circumference. The supporting element can indifferently be in a sole piece with the mentioned portion 5 or separately connected to it.

With reference to the above mentioned devices (13, 18) a reference bar 13 or bracket can be directly connected, for example welded, in a point of the perimeter of the supporting element 15. Alternatively, the supporting element comprises, according to the preferred solution, a shaped hook 14 to bind, by snap or through for example a magnet, the reference bar 13 (for such aim look at FIGS. 1 and 6) of which the functionality will be better explained further on. The bar is then realized in two portions that result to be respectively pivoted. In such manner the bar can be configured according to a substantially I shape in a closed condition and an L configuration in a using condition.

According to the solution of the magnet bar 13, it is then also comprised along the fixed portion 4 a further hook 12. In such manner, once the bar is used, it is possible to remove it from the magnetic hook 4 of the head and place it in correspondence of the hook 12. Such solution is extremely convenient for saving encumbrances.

Figure 6:
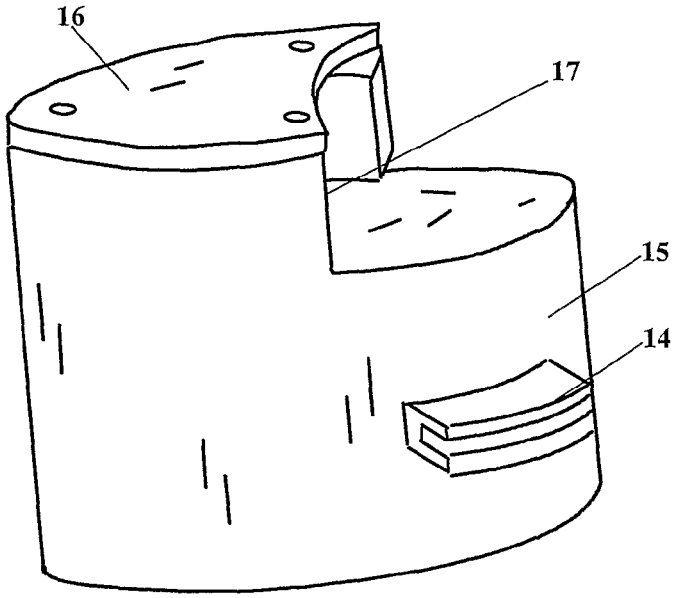
FIG. 6 shoes a complex view of the head 15 and two respectively lateral and frontal view of the head that assembles the measuring tape for circumference measurement.
Figure 6:
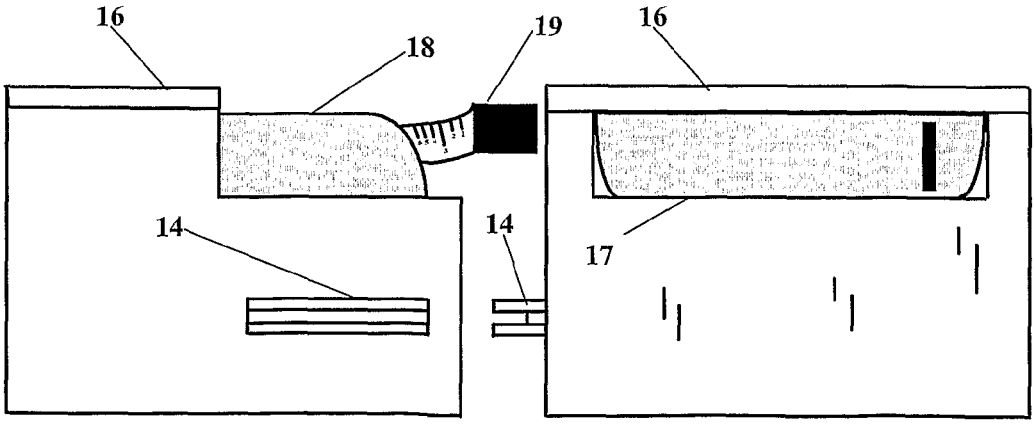

By looking at FIG. 6, the supporting element 15 comprises an internal site 17 limited at the top by an upper closing lid 16. The lid can be fixed through simple screws or similar devices and results thus to be easily removable. The site 17 receives in its inside a traditional measuring tape 18 with an internal spring of automatic wrap type suitable for measuring a circumference. The frontal and lateral views shown in FIG. 6 both show the head 15 and the measuring tape 18 assembled in its inside. In such manner the user can selectively extract the strip 19 of the measuring tape to make the measurement and retract it by simply pushing the releasing button typical of such measuring tapes while the container of the same 18 is maintained fixed within the site. For such aim, for example, the same upper closing lid 16 of the site can realize an interference such to maintain the measuring tape within the site 17. In such case its removal is possible further to the disassembling of the lid. Other equivalent blocking solution of the measuring tape within the site can anyway be used without having for this reason to move apart from the present inventive concept.

Having thus substantially described the device in its essential technical aspects, it is now explained in its functional aspect.

Figure 7:
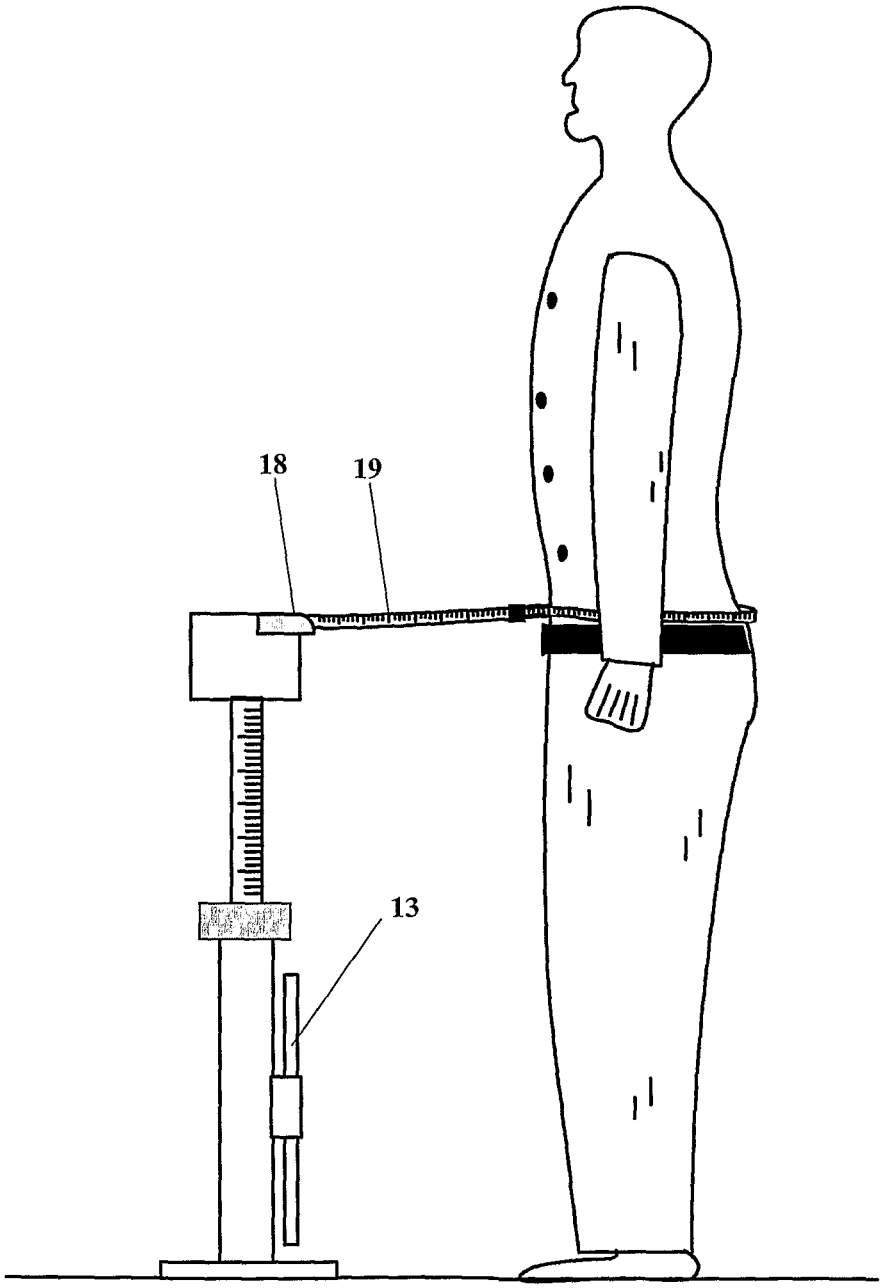
FIGS. 7 and 8 show steps of circumference and height measurement according to the invention.
Figure 8:
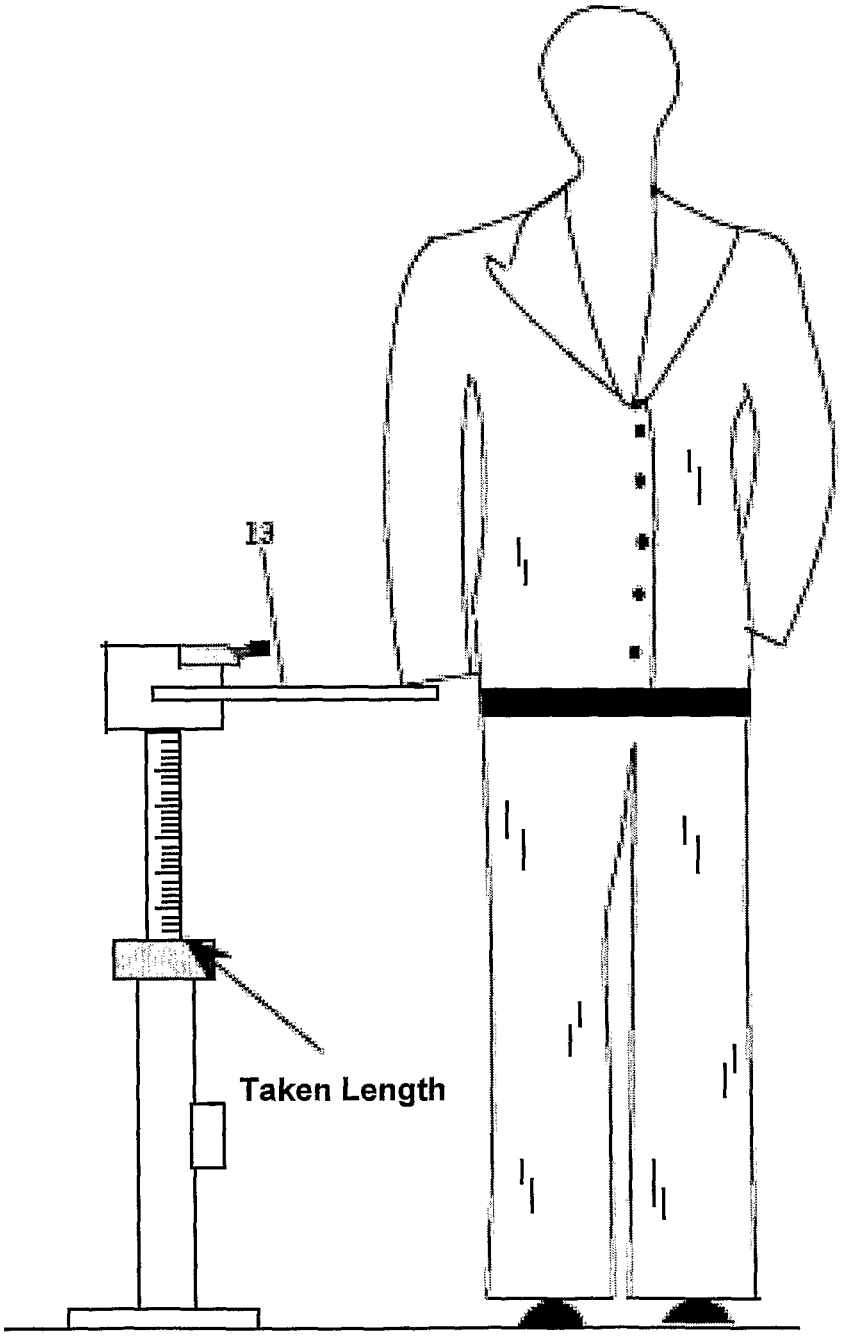

FIGS. 7 and 8 show a body of a person in order to detail the using steps of the present device. The operator that has to take the measures places the device close to the body. By simply extracting or retracting the movable portion with respect to the fixed one it is possible to place the supporting element 15 at the desired height. Particularly FIG. 8 shows a height signed by the reference bar 13. In this manner, in correspondence of the extraction of the arm, the graduated scale indicates the length. At the same time, it is also possible to take a circumference measure by extracting the strip 19 that constitutes the measuring tape 18. FIG. 7 shows, only for convenience, the bar 13 placed back to the resting position in correspondence of the hook obtained on the base 4.

Figure 9:
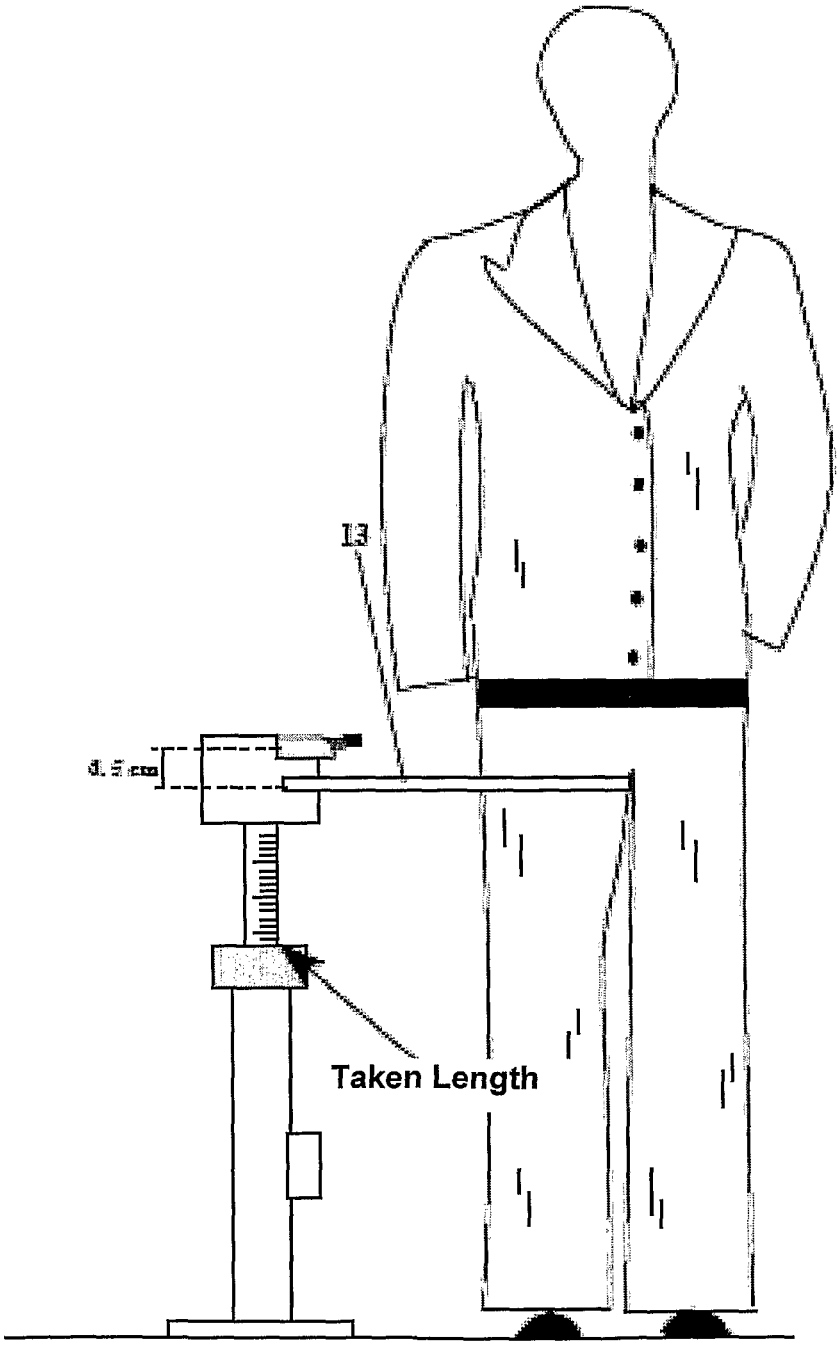
Figure 10:
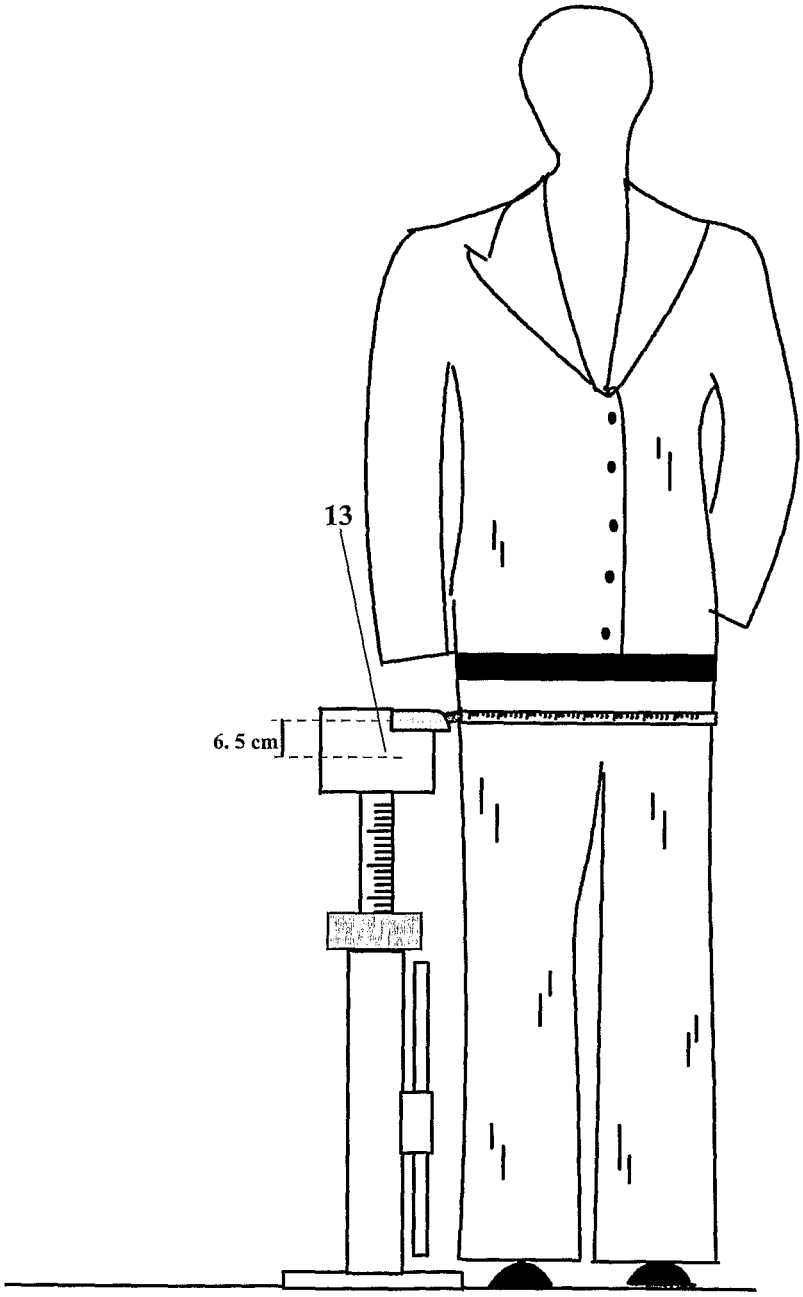
Figure 11:
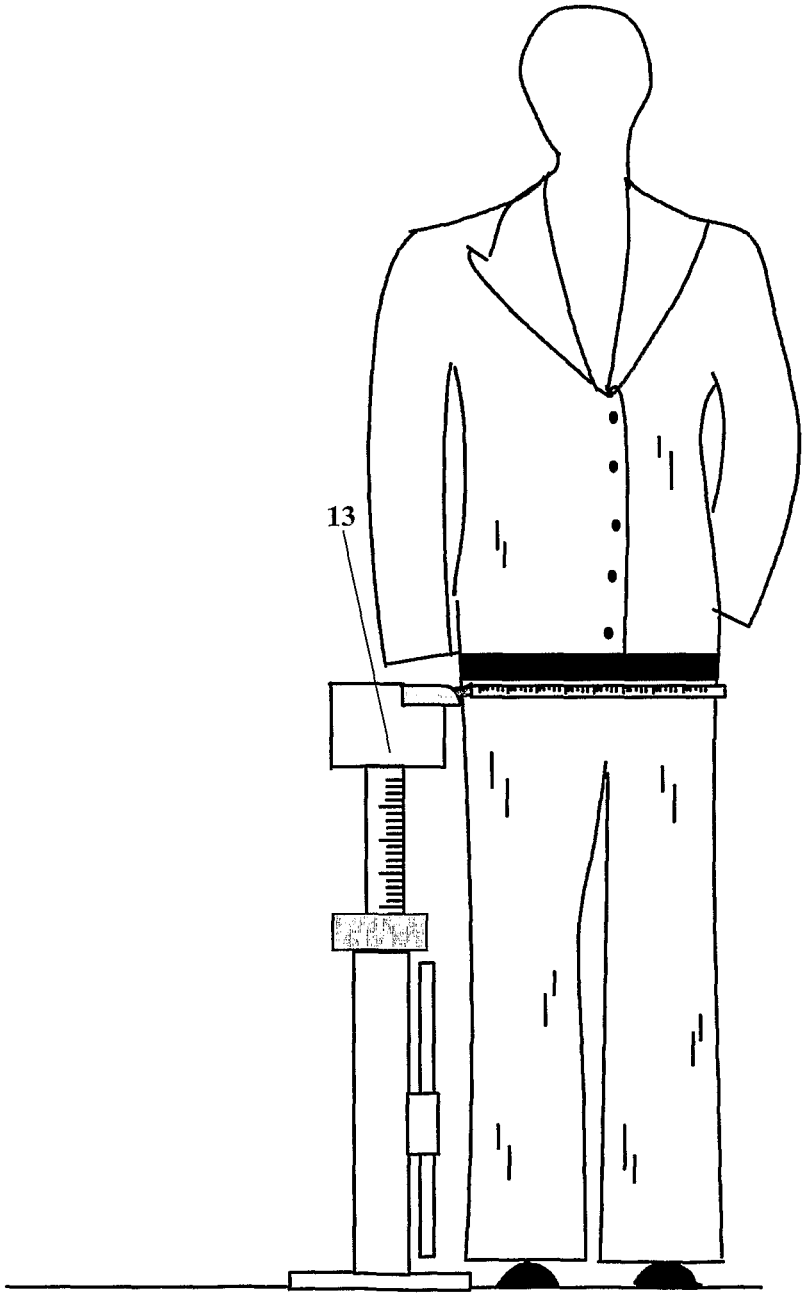

Only as an example the following FIGS. 9, 10 and 11 show three further measurement steps for the realization, for example, of a trouser.

The instrument is initially placed at the side of the person, or at the left or at the right. The bracket is thus removed by the specific magnetic hold support and inserted on top of said element 15. Follows the lifting of the millimetric telescopic arm in such a way that the bracket 13 touches the upper part of where the leg cross, fixing it with the specific metal ring 7 The height resulting at the edge of the metal ring is then noted, obtaining this way the measurement of the inner part of the legs with a non excessive result. With the arm that is blocked as above, the measuring tape is wrapped around the pelvis of the person (look at FIG. 10). Being the measuring tape placed at a prefixed position of the head, or rather, in one embodiment, at the exact height of 6.5 cm from the crossing of the crotch (or rather from the bracket 13), at this point the measurement of the waist is achieved in an automatic manner independently from whom takes these measures, even if that is a person with no experience. As shown in FIG. 11, by unblocking the metal ring, the millimetric bar is raised until the head of the meter is brought to the desired waist point of the person (generally above the hip) and then the metal ring is blocked again. The measure found at the height of the metal ring is read and noted down, and by wrapping the measuring tape around the waist, as if it was a belt, it is unwrapped with the button and forced into the right tension desired by the client. In this manner the height of the mast is obtained (it is obtainable with a simple calculation) and the circumference of the waist.

Thus it results clear from such description not only how simple and fast the measurement becomes, but also how it is possible to take in a precise manner the length and circumference placed at different heights. In such manner, the measures result accurate even if they have been taken by non expert operators.

At last it is clear how such solution can be modified comprising a supporting element 15 with no site 17 and supplied with only a reference bar 13 for the measurement of the length or, in the contrary, supplied exclusively with a site 17 for the measurement of the sole circumference.

Moreover electronic saving devices, as for example a computer, can allow saving directly the taken data on a CD in a way to store them until the cloth is made.

Definitively, the above mentioned description of a specific realization embodiment shows the invention from the conceptual point of view in a way that others, by using the prior art, can modify and/or adapt in different application such specific realization pattern without further researches and without moving apart from the present inventive concept and, thus, it is intended that such adaptations and amendments will be considered equivalent to the specific realization pattern. The means and material to realize the different described functions can be of various types without moving apart from the inventive concept. It is intended that the expressions or the used terminology have only the aim of describing and for this reason are not limiting.

The invention claimed is:

1. A device for reading measures of a body of a person to make trousers, comprising:

an arm (2), wherein said arm (2) is and comprises a fixed base portion (4) and an upper portion (5) that is selectively extendible or retractable from and to an inside of said fixed base portion; and means (11, 13, 15, 18) to take measurements of the trousers, a graduated marker (11) placed along said upper portion (5) and configured to indicate a reached length in correspondence of extraction or retraction of said upper portion (5) in respect to said fixed base portion (4), wherein said means (11, 13, 15, 18) to take measurements of the trousers comprise at least a supporting element (15) having a device (13, 14, 18, 19) that allows a reading of one or more of a length or a width of the body, wherein said supporting element (15) is placed at or in proximity of an upper end of the upper portion (5), wherein said device (13, 14, 18, 19) comprises at least a reference lever (13) configured to indicate a position of the crotch of the person by extending or retracting the arm, wherein said device (13, 14, 18, 19) further comprises an engaging member (14) firmly connected to said supporting element (15) to receive and removably engage said reference lever (13), wherein said supporting element (15) further comprises a site (17) positioned above said engaging member and configured to receive a measuring tape (18, 19) for taking a measurement of a circumference in correspondence of a chosen length of the arm, said measuring tape being extendible and rewrappable, further comprising means (6) to fix said arm at a chosen length such to allow a user to take, in correspondence of said length and through said means (11, 13, 15, 18) to take measurements, a reading of at least a measure on the body.

2. The device of claim 1, wherein said fixed base portion (4) comprises a supporting base (3) configured to place said arm (2) on a ground in upward emerging position.

3. The device of claim 1, wherein said reference lever is integrated in said supporting element (15).

4. The device of claim 1, wherein said engaging member (14) is magnetic and the lever (13) is metallic such to remain into fixedly coupled thereto.

5. The device of claim 4, further comprising a second engaging member (12) disposed on the fixed base portion (4), said second engaging member being configured to receive and engage the reference lever (13) after removal from the engaging member (14).

6. The device of claim 1, wherein said graduated marker (11) comprises indicia disposed on said upper portion (5).

7. The device of claim 1, wherein said supporting element (15) comprises a display configured to visualize a reached length measurement and electronic reading means connected to said display to send said length measurement to said display.

8. The device of claim 1, wherein said measuring tape is placed at a height of 6.5 cm in respect to a positioning of said reference lever (13) when placed on said supporting element (15).

9. The device of claim 1, wherein said site is closed at the top by an upper lid (16) in a way to retain the measuring tape within the site.

10. The device of claim 1, wherein said means (6) to fix the arm at a chosen length comprise a knob (7) and a hollow spacer (8) configured with such a diameter to surround the upper portion (5).

11. The device of claim 10, wherein the knob is configured to get screwed at the upper end of the fixed base portion (4) such to fix the spacer around said upper portion (5), fixing it into position, or to get unscrewed to allow the spacer to release the upper portion.

12. The device of claim 1, wherein the reference lever comprises two portions pivotally coupled to one another, whereby the reference lever can be configured both in a I shape and an L shape during rest or use.

13. A device for reading measurements of a body of a person to produce trousers therefor, the device comprising:

an arm (2) that is telescopic and has a fixed base portion (4) and an upper portion (5) selectively extendable or retractable from and into an inside of the fixed portion (5);

a plurality of elements (11, 13, 15, 18) configured to provide the measurements of the body; and a system (6) that fixes the arm (2) at a chosen length, thereby allowing, in correspondence of the chosen length, a reading of one or more of the measurements of the body through the plurality of elements (11, 13, 15, 18); and a graduated scale (11) provided on the upper portion (5) and configured to indicate the chosen length when reached after extending or retracting the upper portion (5) from or into the fixed base portion (4), wherein the plurality of elements (11, 13, 15, 18) comprise a supporting element (15), disposed at or in proximity of an upper end of the upper portion (5), the supporting element (15) comprising, a device (13, 14, 18, 19) configured to read one or both of a length or a width of the body, the device (13, 14, 18, 19) comprising a reference lever (13) that indicates a position of the crotch of the person after extending or retracting the arm, the reference lever (13) being integrated in the supporting element (15), and a site (17) having a measuring tape (18) therein, the measuring tape (18) having a strip (19) that automatically wraps inside the site and that is configured to take a measurement of a circumference at the chosen length of the arm (2), the site (17) being positioned at a distance above the reference lever (13).

* * * * *